US007413160B2

(12) United States Patent
Beilharz et al.

(10) Patent No.: US 7,413,160 B2
(45) Date of Patent: Aug. 19, 2008

(54) METHOD FOR DETERMINING A CLOSING TIME OF A CLOSING ELEMENT AND CIRCUIT ARRANGEMENT

(75) Inventors: Jörg Beilharz, Berlin (DE); Sven Rebeschiess, Kleinmachnow (DE); Christian Rissler, Berlin (DE); Hans-Jörg Wiehoff, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/568,367

(22) PCT Filed: Mar. 26, 2005

(86) PCT No.: PCT/EP2005/003223

§ 371 (c)(1),
(2), (4) Date: Jul. 6, 2007

(87) PCT Pub. No.: WO2005/108765

PCT Pub. Date: Nov. 17, 2005

(65) Prior Publication Data

US 2007/0251492 A1 Nov. 1, 2007

(30) Foreign Application Priority Data

Apr. 28, 2004 (DE) ..... 10 2004 020 937

(51) Int. Cl.
*F02M 47/00* (2006.01)

(52) U.S. Cl. ..... 251/30.01; 123/447; 123/459; 123/506

(58) Field of Classification Search ..... 123/447, 123/459, 506; 251/30.01
See application file for complete search history.

(56) References Cited

U.S. PATENT DOCUMENTS

| | | | | |
|---|---|---|---|---|
| 4,870,939 | A * | 10/1989 | Ishikawa et al. | 123/506 |
| 5,803,049 | A * | 9/1998 | Harcombe | 123/506 |
| 6,766,241 | B2 * | 7/2004 | Treichel | 123/506 |
| 6,820,596 | B2 * | 11/2004 | Namari et al. | 123/501 |
| 2003/0120418 | A1 * | 6/2003 | Treichel | 123/506 |

FOREIGN PATENT DOCUMENTS

| | | | |
|---|---|---|---|
| DE | 199 58 262 | A1 | 7/2001 |
| EP | 1 138 909 | A1 | 10/2001 |
| WO | 03/067073 | A1 | 8/2003 |
| WO | 03/104633 | A1 | 12/2003 |

OTHER PUBLICATIONS

International Search Report and Written Opinion for International Application No. PCT/EP2005/003223 (10 pages).

* cited by examiner

*Primary Examiner*—Erick Solis
(74) *Attorney, Agent, or Firm*—Baker Botts L.L.P.

(57) ABSTRACT

In a method for determining the closure time for a valve, operated by a piezoelectric actuator, in order to record the closing time, the voltage at the piezoelectric actuator is recorded and the time is recorded at which the voltage has a maximum difference value from a comparison curve. The difference curve is generated between a start and an end point for a measured curve, having the voltage values applied to the piezoelectric actuator. A precise determination of the closing time can thus be carried out.

9 Claims, 4 Drawing Sheets

METHOD FOR DETERMINING A CLOSING TIME OF A CLOSING ELEMENT AND CIRCUIT ARRANGEMENT

CROSS-REFERENCE TO RELATED APPLICATIONS

This application is a U.S. national stage application of International Application No. PCT/EP2005/003223 filed Mar. 26, 2005, which designates the United States of America, and claims priority to German application number DE 10 2004 020 937.5 filed Apr. 28, 2004, the contents of which are hereby incorporated by reference in their entirety.

TECHNICAL FIELD

The invention relates to a method for determining a closing time of a closing element according to the preamble of claim 1 and a circuit arrangement for determining the closing time of a closing element according to the preamble of claim 5.

BACKGROUND

In the field of motor vehicle technology, in hydraulically controlled injection systems, such as a pump-nozzle system, valves are used, which are operated by means of a piezoelectric actuator. Determination of the closing time of the valve used to adjust the hydraulic pressure is an important parameter for the hydraulically controlled injection system and it must be detected and controlled in a precise manner.

A method and device for regulating the quantity injected in the case of a fuel injection valve with a piezoelement actuator are known from DE 199 30 309 C2. The fuel injection valve has a control chamber, which is located in a high-pressure receiver and connected to a control valve. Pressures in the control chamber act on a movable nozzle body with a nozzle needle for opening and closing injection holes. The control valve is operated by the piezoelectric actuator to open the injection valve. The voltage at the piezoelectric actuator is detected after initial charging and the start of injection and/or the needle opening time of the injection valve is/are determined from the measured voltage.

SUMMARY

The object of the invention is to provide a reliable and precise method for determining the closing time of the closing element of the piezoelectrically driven valve. The object of the invention is also to provide a circuit device, which can be used in a simple manner to determine the closing time of the valve driven by the piezoelectric actuator.

In an embodiment of a method for determining a closing time of a valve, having a closing element, which is operated by a piezoelectric actuator, the method may comprise the steps of: detecting the electrical voltage at the actuator during a closing process of the valve, evaluating the voltage to determine the closing time, detecting voltage values for the voltage in a measuring interval with a start and end point, establishing a comparison curve between the voltage values of the start and end point, determining differential values between the measured voltage values and the simultaneous values of the comparison curve for a number of measured voltage values, and identifying the time, when the differential value is greatest, as the closing time.

In yet another embodiment, a circuit arrangement for determining a closing time of a closing element of a valve, which is pushed onto a valve seat or lifted from the valve seat with a piezoelectric actuator, may comprise a first means for detecting the voltage, which detects the electrical voltage at the actuator during a closing process of the valve, with a second means, which evaluates the voltage to determine the closing time, wherein a third means is provided, which specifies a measuring interval with a start point and an end point, a fourth means is provided, which establishes a comparison curve between the measured voltage values of the start and end points, a fifth means is provided, which determines differential values between the detected voltage values and the simultaneous values of the comparison curve for a number of time point within the measuring interval, a sixth means is provided, which specifies a time, when the greatest differential value is present, as the closing time.

One advantage of the inventive method is that the closing time of the valve can be determined precisely. To determine the closing time of the valve, according to the invention a comparison line is drawn between a start and end point of a measuring interval and the voltage present at the piezoelectric actuator is detected during the measuring interval. Differential values are determined between the measured voltage values and the comparison line and the closing time is identified at the time when the differential value has the greatest value within the measuring interval.

In a preferred embodiment the measured voltage values are further processed as squared variables. This allows precise determination of the closing time.

In a further preferred embodiment a closing time is only identified, when the differential value exceeds a specified comparison value. This prevents a closing time being detected for a valve that is not closed.

In a further preferred embodiment of the inventive method a closing time is only identified, when the total of the differential values of the measuring interval exceed a specified comparison total. This further condition also serves to ensure reliable identification of a closing time.

BRIEF DESCRIPTION OF THE DRAWINGS

The invention is described in more detail below with reference to the figures, in which.

DETAILED DESCRIPTION

Figure 1:
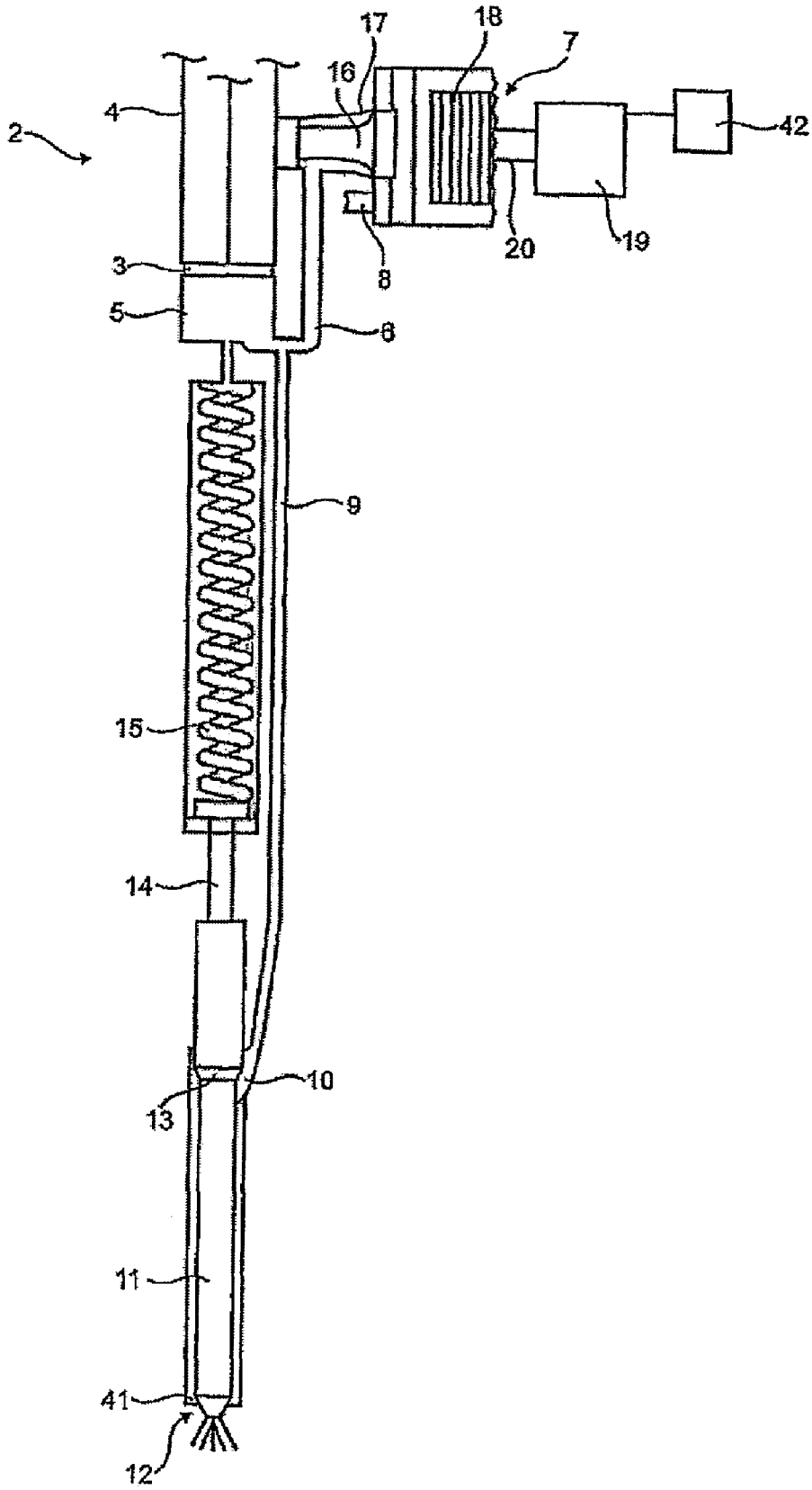
FIG. 1 shows a schematic diagram of an injection valve configured according to the pump-nozzle principle.

FIG. 1 shows a schematic diagram of the structure of a pump-nozzle unit. The pump-nozzle unit is used to feed fuel into a combustion chamber 1 of an internal combustion engine. The pump-nozzle unit has a pump 2, which compresses fuel by way of a piston 3, which is guided into a cylinder 4. The piston 3 is driven directly or indirectly by way of a camshaft (not shown) of the internal combustion engine. A first pressure chamber 5 is configured in the cylinder 4 adjacent to the piston 3. The first pressure chamber 5 is connected by way of a fuel line 6 to a valve 7. The valve 7 is used either to close off the fuel line 6 or connect it to a low-pressure region 8. The pressure chamber 5 is also connected to an injection chamber 10 by way of a second fuel line 9. A nozzle needle 11 is disposed in the injection chamber 10, the closing surfaces of said nozzle needle 11 being assigned to a sealing seat 41. The sealing seat 41 is disposed between injection holes 12 and the injection chamber 10. In the upper region of the injection chamber 10 the nozzle needle 11 has pressure surfaces 13. The nozzle needle 11 is pretensioned by a fuel pressure in the injection chamber 10 counter to a closing direction away from the sealing seat 41 by way of the pressure surface 13. The nozzle needle 11 is pretensioned onto the sealing seat 41 by a spring element 15 by way of a pressure pin 14.

The valve 7 has a closing element 16, which is assigned to a valve sealing seat 17. The closing element 16 is connected in a functional manner to a piezoelectric actuator 18, which is activated by a control device 19.

When the valve 7 is opened, the upward intake movement of the piston 3 sucks fuel into the pressure chamber 5 by way of the low-pressure region 8, the valve 7 and the fuel line 6. The low-pressure region 8 is connected to a fuel tank for this purpose. During a downward compression movement of the piston 3, if the valve 7 is open, the fuel is pushed back into the low-pressure region 8. The fuel lines, the injection chamber 10 and the second fuel line 9 are completely filled with force [sic].

To start the injection process, the valve 7 is closed by way of the control device 19 and the piezoelectric actuator 18 during a compression stroke, in which the piston 3 moves downward. The fuel compressed by the piston 3 can then not escape by way of the low-pressure region 8 but a high pressure is generated in the injection chamber 10. The high pressure lifts the nozzle needle 11 from the assigned sealing seat 41. Fuel is then emitted from the injection chamber 10 by way of the injection holes 12 into the combustion chamber 1 of the internal combustion engine. When the valve 7 is opened, in other words the closing element 16 is lifted from the assigned sealing seat 17 by the piezoelectric actuator 18, the fuel pressure in the fuel line 6 and therefore also in the injection chamber 10 drops. The nozzle needle 11 is then pushed back onto the sealing seat and the connection between the injection chamber 10 and the injection holes 12 is closed off. Injection is therefore terminated.

For precise determination of the time, when the valve 7 with closing element 16 is pushed back onto the valve sealing seat 17, the voltage present at the piezoelectric actuator 18 is evaluated. The piezoelectric actuator 18 is supplied with voltage by the control device 19 by way of voltage lines 20. The control device 19 also uses the voltage lines 20 to detect the voltage present at the piezoelectric actuator. The control device 19 therefore has both a voltage source and a voltage meter. The control device 19 is also connected to a data storage unit 42.

The valve 7 is configured such that, when the piezoelectric actuator 18 is in a non-energized state, the closing element 16 is lifted from the valve sealing seat 17 and the valve 7 is therefore opened.

Figure 2:
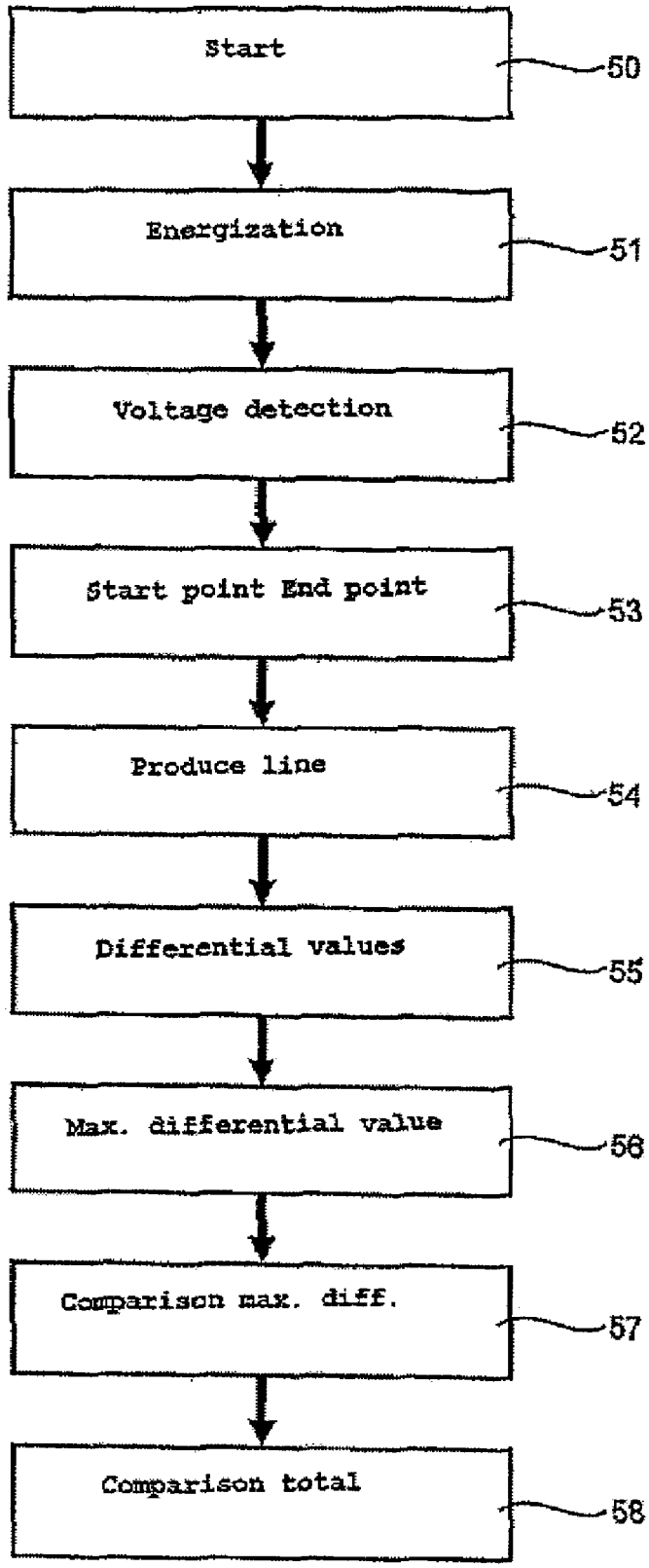
FIG. 2 shows a schematic program flow for determining the closing time.

FIG. 2 shows a schematic program flow for implementing the method. At program point 50 the control device 19 detects various operating states, such as the speed of the internal combustion engine and the driver's intention and thereupon determines the start of injection and the duration of injection. To this end the control device 19 accesses corresponding data and characteristics, which are stored in the data storage unit 42. At the next program point 51 the control device 19 applies a corresponding voltage to the piezoelectric actuator 18 by way of the voltage lines 20. The piezoelectric actuator 18 is thereupon extended and pushes the closing element 16 onto the valve sealing seat 17, during a compression stroke of the piston 3. At the next program point 52 the control device applies the voltage to the piezoelectric actuator 18 and parallel thereto monitors the voltage present at the piezoelectric actuator 18. To this end the control device 19 detects the voltage present at the actuator 18 at specified time intervals. A diagram with a corresponding measurement curve is shown in FIG. 3.

Figure 3:
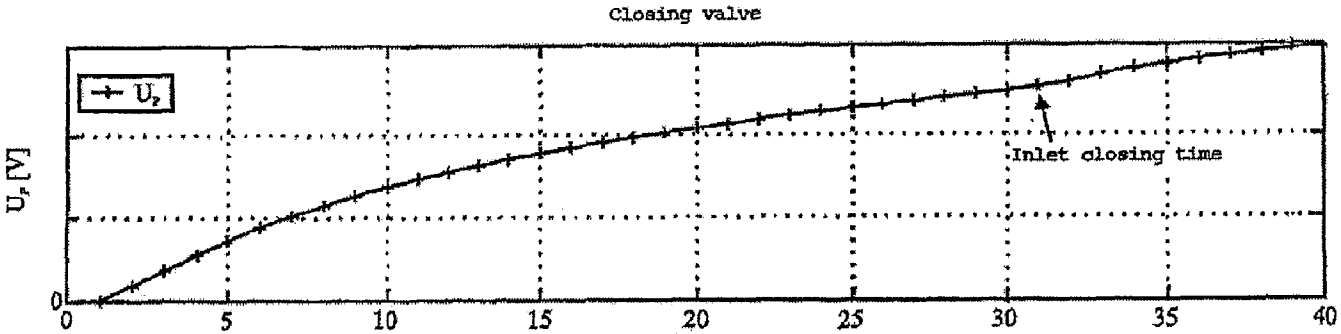
FIG. 3 shows a measurement curve for the voltage present at the actuator during a closing process of the valve.

FIG. 3 shows the measurement curve, which is plotted on the basis of the detected voltage values and is stored by the control device 19 in the data storage unit 42.

At the next program point 53 the control device 19 determines a start point TS and an end point TE of a measuring interval in the measurement curve. The start point TS is preferably preset and follows a specified time after the start of energization of the piezoelectric actuator. The end point is preferably also preset and follows a specified second time after the start of energization of the piezoelectric actuator. At a next program point 54 the control device 19 also calculates a comparison line between the measured value of the start point and the measured value of the end point. At a next program point 55 the control device 19 determines the differential value in relation to the corresponding value of the reference curve for every measured voltage value in the measuring interval between the start point and end point. To this end the measured voltage value and the value of the reference curve associated with the same time point are subtracted from each other. The control device 19 stores the differential values in the storage unit 21.

Figure 4:
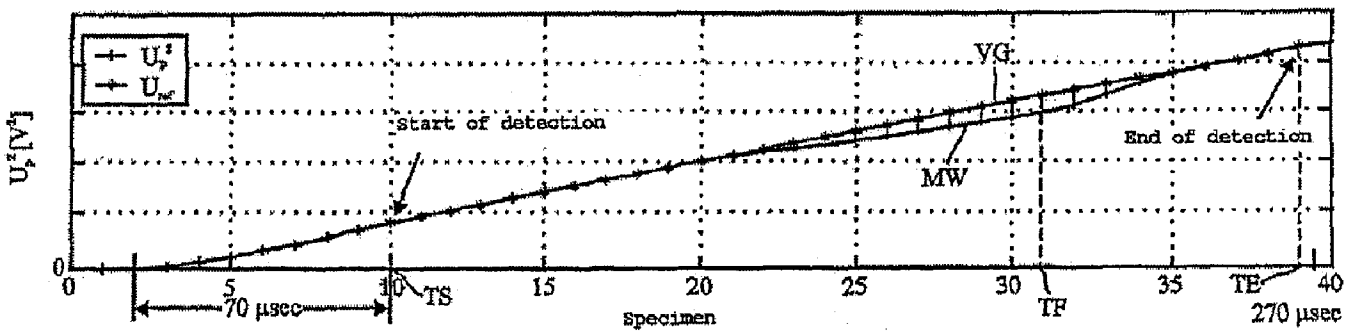
FIG. 4 shows the measurement curve with a reference curve.

FIG. 4 shows a corresponding measurement diagram, in which the start point TS and end point TE are marked. The comparison line VG is also shown in the form of a line with asterisks. The measured values of the voltage of the piezoelectric actuator detected by the control device 19 are shown in the form of crosses and an approximated line MW.

Instead of the measured voltage values, the control device 19 preferably uses squared voltage values, as this allows more precise determination of the closing time.

At the next program point 56 the control device 19 determines the biggest differential value between a measured voltage value and the simultaneous value of the reference curve within the measuring interval and assigns the closing time of the valve 7 to the time, when the biggest differential value occurred. The closing time TF is also marked on the diagram in FIG. 4.

Figure 5:
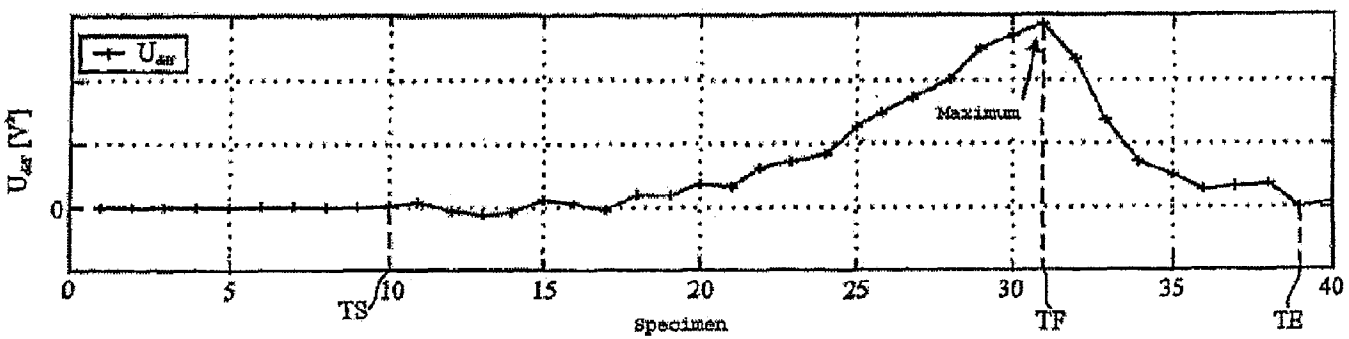
FIG. 5 shows a differential curve formed from the measurement curve and the reference curve and FIG. 6 shows a detailed diagram of the circuit arrangement used to detect the closing time.

FIG. 5 shows the differential values between the measured voltage values and the temporal values of the comparison line, the differential values being determined on the basis of squared voltage values.

In a preferred embodiment after program point 56 and also at the next program point 57 it is checked whether the calculated maximum differential value is above a specified comparison value. If the comparison shows that the maximum differential value is not above the comparison value, a closing time of the valve 7 is not identified. The specified comparison value was determined beforehand, by experiment for example. This allows a malfunction of the valve 7 to be filtered out when determining the closing time.

In a further preferred embodiment of the invention, either in addition to program point 57 or instead of program point 57 at a next program point 58 the control device 19 generates the total of the differential values and compares it with a comparison total. If the comparison shows that the total of the differential values is smaller than the comparison total, a closing time of the valve is similarly not identified. The comparison total is also preferably determined beforehand by experiment and is used to filter out malfunctions of the valve, which mean that the valve does not close, when determining the closing time. Comparison of the total of the differential values with the comparison total makes it possible to filter out negative differential values, where the measured voltages are above the comparison line, but do not correspond to valve closing. The comparison total is preferably determined by experiment for the respective pump-nozzle unit.

Figure 6:
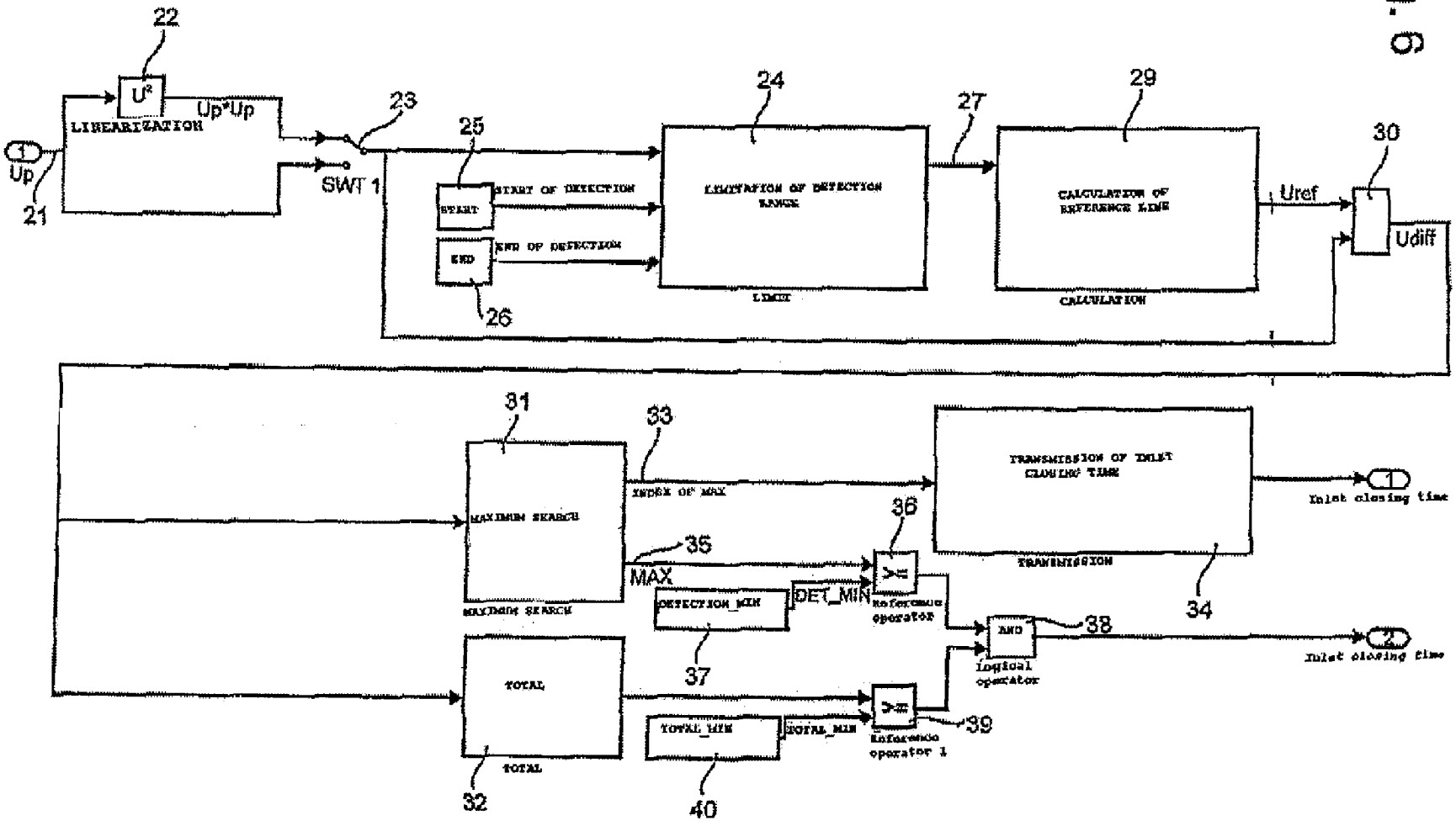

FIG. 6 shows a detailed diagram of the circuit arrangement, which is preferably configured in the control device 19.

The voltage detected at the piezoelectric actuator 18 is fed by way of an input 21 and a linearization module 22 to a second input of a switching device 23. The detected voltage value is squared in the linearization module 22 and fed by way of an output to a second input of the switching device 23. One output of the switching device 23 is connected to a first computation block 24. The first computation block 24 limits the detection range, in which the voltage is detected. A start block 25 and an end block 26 are also provided, which are connected by way of a signal line respectively to an input of the first computation block 24. The start block 25 contains a start time for the measurement, which is specified by the control device 19. The start time is forwarded to the first computation block 24. The end block 26 contains an end time for the measurement, which is also specified by the control device 19. The end time is forwarded to the first computation block 24. To determine the measurement curve, a complete injection process with a number of measured values, i.e. voltage values, is detected. For example 40 measured values are detected, having a specified time interval and being numbered with a continuous index. It is possible to determine the measurement time from the start time, the specified time interval and the index. The first computation block 24 forwards the voltage values supplied by the switching device 23, which represent a complete measurement curve, as shown in FIG. 4, by way of a first output 27 to a second computation block 29. The second computation block 29 uses the voltage values supplied to it within the measuring interval to determine voltage reference values, which represent the comparison line according to FIG. 4. The second computation block 29 forwards the voltage reference values to an adding unit 30 by way of an output. The switching device 23 also feeds the linearized or non-linearized voltage values of a measurement curve with a negative sign to the adding unit 30. Differential values for simultaneous voltage values and reference voltage values of the measurement curve are produced in the adding unit 30 and fed by way of an output of the adding unit 30 to an input of a third and fourth computation block 31, 32.

In the third computation block 31 the maximum differential value is determined within the measuring interval defined by the start point and end point and fed by way of an output to a fifth computation block 34. In the fifth computation block 34 the index of the maximum differential value is used to calculate the time of the maximum differential value and therefore the closing time of the valve and this is fed by way of an output to the control device 19. To this end a time value is assigned to every index in an assignment table. A second output 35 of the third computation block 31 sends the maximum differential value to a comparison facility 36. A first memory field 37 is also provided, wherein a minimum comparison value is specified. The minimum comparison value is determined by experiment. The first memory field predetermines a minimum voltage differential value, which is fed to a second input of the comparison facility 36. The comparison facility 36 compares whether the maximum differential value is greater than or equal to the minimum differential value and forwards a signal by way of an output to a second comparison facility 38, if this condition is satisfied.

The fourth computation block 32 adds together the differential values of the individual measuring points within the measuring interval of the measurement curve and forwards a total differential value by way of an output to a third comparison facility 39. A second input of the third comparison facility 39 is connected to an output of a second memory field 40. A minimum total is stored in the second memory field 40 and fed to the third comparison facility 39. The third comparison facility 39 compares the differential total calculated by the fourth computation block 32 with the minimum total stored in the memory field 40. If the comparison by the third comparison facility 39 shows that the differential total is greater than or equal to the minimum total, a signal is emitted to the second comparison facility 38. If the comparison facility 38 identifies two signals at the two inputs, the second comparison facility 38 sends an enable signal to the control signal [sic] 19 to confirm the validity of the identified closing time.

Depending on the embodiment selected, it is possible to dispense with individual or all of the comparison facilities 36, 39, 38, which carry out a plausibility check on the measured values.

What is claimed is:

1. A method for determining a closing time of a valve, having a closing element, which is operated by a piezoelectric actuator, the method comprising the steps of:

detecting the electrical voltage at the actuator during a closing process of the valve, evaluating the voltage to determine the closing time, detecting voltage values for the voltage in a measuring interval with a start and end point, establishing a comparison curve between the voltage values of the start and end point, determining differential values between the measured voltage values and the simultaneous values of the comparison curve for a number of measured voltage values, identifying the time, when the differential value is greatest, as the closing time.

2. The method according to claim 1, wherein the voltage values are used as a squared variable.

3. The method according to claim 1, wherein a closing time is only identified, when the differential value exceeds a specified comparison value.

4. The method according to claim 1, wherein a closing time is identified on condition that the total of the differential values exceeds a specified comparison total.

5. A circuit arrangement for determining a closing time of a closing element of a valve, which is pushed onto a valve seat or lifted from the valve seat with a piezoelectric actuator, with a first means for detecting the voltage, which detects the electrical voltage at the actuator during a closing process of the valve, with a second means, which evaluates the voltage to determine the closing time, wherein a third means is provided, which specifies a measuring interval with a start point and an end point, a fourth means is provided, which establishes a comparison curve between the measured voltage values of the start and end points, a fifth means is provided, which determines differential values between the detected voltage values and the simultaneous values of the comparison curve for a number of time point within the measuring interval, a sixth means is provided, which specifies a time, when the greatest differential value is present, as the closing time.

6. A system for determining a closing time of a valve, having a closing element, which is operated by a piezoelectric actuator, comprising a control unit comprising an electrical voltage detector coupled with the actuator to determine the voltage during a closing process of the valve, the control unit further detecting voltage values for the voltage in a measuring interval with a start and end point, establishing a comparison curve between the voltage values of the start and end point, determining differential values between the measured voltage values and the simultaneous values of the comparison curve for a number of measured voltage values, and identifying the time, when the differential value is greatest, as the closing time.

7. The system according to claim 6, wherein the voltage values are used as a squared variable.

8. The system according to claim 6, wherein a closing time is only identified, when the differential value exceeds a specified comparison value.

9. The system according to claim 6, wherein a closing time is identified on condition that the total of the differential values exceeds a specified comparison total.

* * * * *